US007900813B2

(12) United States Patent
Dodson

(10) Patent No.: US 7,900,813 B2
(45) Date of Patent: Mar. 8, 2011

(54) VISUALLY ENHANCED TAB FILE SYSTEM

(75) Inventor: Darryll Dodson, Minneapolis, MN (US)

(73) Assignee: Smead Manufacturing Company, Hastings, MN (US)

( * ) Notice: Subject to any disclaimer, the term of this patent is extended or adjusted under 35 U.S.C. 154(b) by 628 days.

(21) Appl. No.: 11/965,896

(22) Filed: Dec. 28, 2007

(65) Prior Publication Data

US 2008/0156853 A1 Jul. 3, 2008

Related U.S. Application Data

(60) Provisional application No. 60/877,534, filed on Dec. 28, 2006.

(51) Int. Cl.
*B65D 27/00* (2006.01)
*B42F 15/00* (2006.01)

(52) U.S. Cl. ..... 229/67.2; 229/67.1; 312/184

(58) Field of Classification Search ..... 229/67.1–67.4; 312/184

See application file for complete search history.

(56) References Cited

U.S. PATENT DOCUMENTS

| | | | | | |
|---|---|---|---|---|---|
| 1,803,823 | A * | 5/1931 | Wittenmyer | 312/184 |
| 2,037,579 | A | 4/1936 | Jonas | |
| 2,248,027 | A * | 7/1941 | Maass | 211/46 |
| 2,318,077 | A | 5/1943 | Jonas | |
| 2,484,453 | A * | 10/1949 | Halverson | 211/46 |
| 2,874,699 | A * | 2/1959 | Dunleavy | 211/126.13 |
| 3,249,111 | A * | 5/1966 | Vincens | 211/162 |
| 3,288,144 | A * | 11/1966 | Hyams | 211/46 |
| D298,265 | S * | 10/1988 | Snider et al. | D19/90 |
| 5,722,692 | A * | 3/1998 | Abramov | 281/43 |
| 6,039,473 | A | 3/2000 | Bond | |
| 6,926,158 | B1 * | 8/2005 | Brown | 211/46 |
| 7,210,659 | B2 * | 5/2007 | Lawson et al. | 248/95 |
| D622,320 | S * | 8/2010 | DeCarlo et al. | D19/90 |
| 2008/0197176 | A1 * | 8/2008 | DeCarlo et al. | 229/67.2 |

* cited by examiner

*Primary Examiner* — Jes F Pascua
(74) *Attorney, Agent, or Firm* — Altera Law Group, LLC

(57) ABSTRACT

A tab system for a folder (10*a*), and a method of making same is disclosed. The tab is enlarged to carry more information/indicia. The visual indicia space (16*a*), i.e. the viewable space on the front (32*a*, 36*a*) of the folder which allows viewing of the enlarged tab is achieve without violating the overall size restrictions (40*a*) of the file folder. Instead, the front of the folder adjacent to the tab on the back panel, is cut away (32*a*,34*a*) to expose a greater portion of the back panel (14*a*) and allow an increase in visual indicia space. The remaining portion of the front panel, not adjacent to the tab may also be cut away (34*a*) to allow other enlarged tab files, with offset tabs, (22*d*, 21*a*) to be viewable behind the present file.

6 Claims, 4 Drawing Sheets

VISUALLY ENHANCED TAB FILE SYSTEM

CROSS REFERENCE TO RELATED APPLICATION

This application claims the benefit of U.S. Provisional Application No. 60/877,534 filed 28 Dec. 2006, which hereby is incorporated herein by reference in its entirety.

FIELD OF THE INVENTION

The present invention is directed to a folder system and method of making folders with index tabs.

BACKGROUND

File folders, hanging file folders and other paper storage systems are of great utility in an office setting. The most common storage system, the common manila folder, for example are widespread and relatively inexpensive, and have convenient tabs suitable for writing. Such folders may be available in hanging or non-hanging versions. There are many other types as well, but of particular interest is their ability to display indicia on a tab by marking/applying data to a region of the folder which is visible when the folder is closed (i.e. the leaves are generally parallel with documents therebetween).

In addition, typically tabbing systems are on the top or side of the file folder. The amount of data which can be displayed is a function of the label size, but there are practical limitations on label size. There are many reasons for wanting to have the maximum writing space available on a file. Obviously the more that is written, the more the user will know about the contents. There are other reasons. Space may be needed for bar coding or color coding. Bar coding usually requires at least 3-5 mm of height for a successful scan. That leaves perhaps 15-20 mm left for human readable indicia. If bar and color coding are used, there may be little or no space left for words and numbers.

On the other hand, it is not practical to increase the overall height of the file folder because the file drawers and other containers built for folders is already standardized and making the tabs taller will simply not be acceptable to users who require backward compatibility to existing systems.

So a solution needs to be found to provide a simple way to make tabs larger without exceeding existing norms for folder file cabinets or the like.

There are other issues relevant to the solution of the present invention and they are detailed below.

BRIEF SUMMARY

Reference should be had to the claims for the scope of invention.

The invention includes a file folder, with increased writable tab surface having a back panel surface having a top edge including a tab, a front panel surface overlying at least a portion of the back panel, said front panel having a cut out portion adjacent said tab and being at least as large as the tab, so that said tab has a portion of its writable surface visible thru the cut out portion of said front panel.

The present invention also includes a method of manufacturing a file folder to have enhanced visual indicia tab space without increasing the overall folder size including providing a folder blank of predetermined dimensions having a front and back panel, the back panel including a tab extension portion extending from an edge of, the back panel said tab having a predetermined height and the front panel likewise having a predetermined height; the front panel overlying the back panel when the folder is in use thereby covering most of the back panel; and reducing the coverage of the back panel at that portion of the back panel which is adjacent to the tab extension by cutting a portion of the front panel away thereby exposing more of said tab.

A further aspect of the invention is a method for making a file folder to have enhanced visual indicia tab with a writable visible tab space larger taller than a predetermined industry standard tab height without increasing the overall folder height by providing a folder blank of predetermined dimensions having a front and back panel, the back panel including a tab extension extending upwardly from an edge of the folder generally equal to a predetermined industry standard tab height above the front panel height, the front panel overlying the back panel when the folder is folded thereby covering most of the back panel, and deleting a portion of the front panel which would lie adjacent to the tab extension on the back panel, said deletion creating a recess in the front panel roughly equal to the predetermined standard tab height; so that the exposed portion of the tab extension is roughly equal to twice the predetermined industry standard tab height allowing additional indicia to be written on said exposed portion.

The present invention has many facets and only a few are set forth in this summary. Reference should be had to the detailed description and the claims for a full definition of the invention.

DETAILED DESCRIPTION OF THE INVENTION

Figure 1:
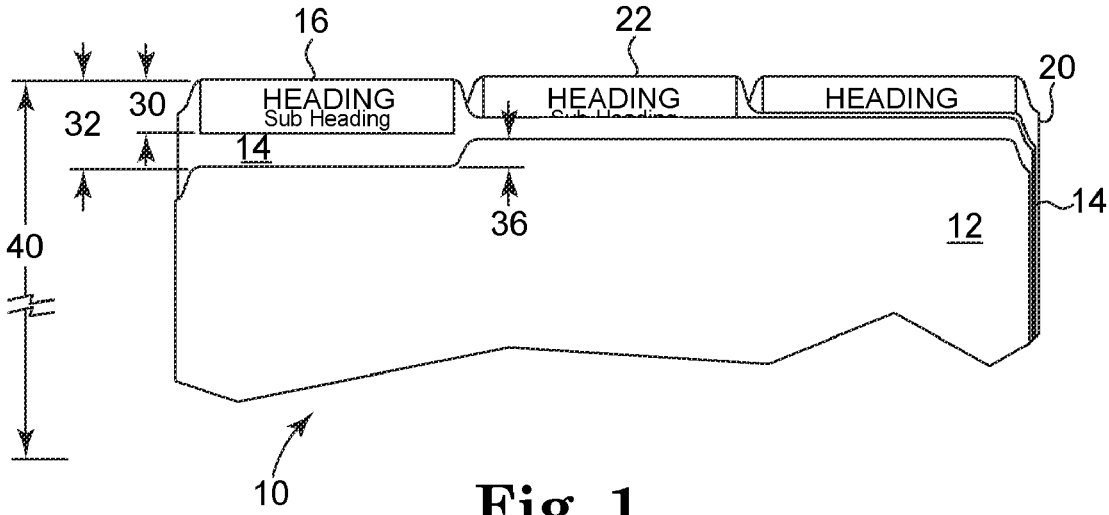
Fig. 1 PRIOR ART
FIG. 1 is a plan view of a series of prior art folders with a unitary/integral top tab attached.

The present invention is directed to a variety of folder-like products which have tabs, most prominently, a tabbed folder (hanging, plain or any other formulation of a pair of substantially planar sidewalls, with one sidewall taller than the other thereby forming a tab which may receive indicia). The tabs may be 2 or 3 dimensional. The term folder is intended to encompass a range of other office requisites, such as binders, folios, clip boards, pockets and similar items, which may have tabs capable of receiving indicia (markings, labels, etc.)

For the sake of brevity, the embodiments in the figures will be discussed simultaneously and the same reference numerals will be used whenever the elements are the same or similar. More information about folders can be learned from the commonly owned patent application Ser. No. 60/835,373 filed on 3 Aug. 2006 titled INTEGRATED TAB HANGING FILE SYSTEM which is incorporated herein by reference.

FIG. 1 illustrates a typical prior art file folder 10 of the simplest kind. Behind it are two additional folders 20 and 22, each of which have tabs visible. This configuration is a three tab cut where three tabs are sequentially offset so that the three tabs can be seen at once. The position of the tabs is considered interchangeable. Side tab versions of the folder are also within the scope of this invention. Likewise, as mentioned above, the term folder encompasses any other structure which could include tabs even if it would not normally be considered a folder. A multi-ring binder with a tabbed panel would be such an example.

Folder 10 has front substantially planar face 12 and a rear face 14. In this case they are joined at the bottom (not shown) though they may also be joined at either side.

The tab 16 has, in this case a label affixed thereon as a way to display the indicia.

Notice that the visibility of the tab depends on height 30 which is the height of the tab, but more importantly the height of the tab is limited by height 32 which is the depth to which the front face 12 is cut to expose the tab face 16. The full height of the folder from the top of the tab to the bottom of the folder (not visible) is identified schematically by numeral 40. It is a length equal to or less than the allowed height for by standardized file cabinets. This height 40 cannot be changed without creating problems with existing standards. Thus to solve the long felt problem of inadequate labeling space on the tabs, another solution was needed.

Figure 2:
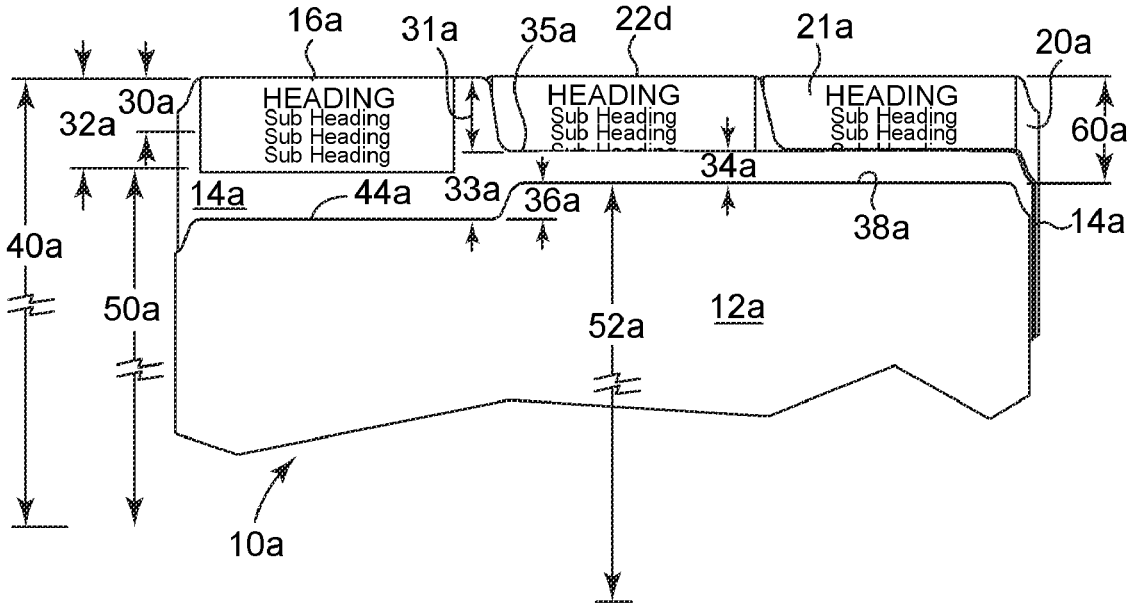
FIG. 2 is a plan view of a series of prior art folders with a unitary/integral top tab attached.

FIGS. 2-5 illustrate embodiments of the present invention. FIG. 2 shows folder 10*a* and behind it are two additional folders 20*a* and 22*a*, each of which have tabs visible. This configuration is a three tab cut where three tabs are sequentially offset so that the three tabs can be seen at once. There are other configurations contemplated by this invention including a single tab spanning the entire width of the folder and any variation less that this full span.

Folder 10*a* has front substantially planar face 12*a* and a rear face 14*a*. In this case they are joined at the bottom (not shown) though they may also be joined at either side.

The tab 16*a* has, in this case a label affixed thereon as a way to display the indicia.

Notice that the visibility of the tab is enhanced by the deep cut illustrated by height 30*a* which is the height of the tab, but more importantly the height of the tab is limited by height 32*a* which is the depth to which the front face 12*a* is cut to expose the tab face 16*a*.

The height 40*a* represents the top to bottom height of file folder 10*a*. This height is standardized in the commerce in different countries, taking into account the typical height of file cabinets and other storage systems. Thus, in resolving the problem of providing greater visible indicia placement space on the tab, it is not possible to increase the height of the tab 16*a* or overall height 40*a* without causing problems with storage in standardized containers. The available visible indicia (labeling) space is defined as the distance from the top of the tab (folder) to the point at which the front face (12*a*) ends and exposes the tab. In FIG. 2, that height is denoted as 32*a*.

To achieve the necessary increase in visible indicia space, the present invention creates a void/notch/recess/cut away portion in the top edge 38*a* of panel 12*a*. The reduction in the front panel 12*a* height is indicated by gap 36*a* so that top edge 44*a* and 38*a* are at different levels, thereby exposing a greater portion of the back panel 14*a*, and hence the visual indicia space of the back panel 14*a* is increased without violating the rule against increasing the overall height 40*a*. Another embodiment (not shown) is where gap 34*a* (between the top edge of the back panel not at the tab), is equal to the top edge of the front pane, not at the cut out, so that gap 34*a* is substantially zero. The preferred construction has edge 35*a* being lowered to what is currently indicated as edge 38*a*. This provides maximum visibility of the tabs behind 22*a* and 21*a* in FIG. 2.

To further increase the utility of the folder, it may also be desirable to cut down the top edge 38*a* of front face 12*a* so that the differential in heights 36 and 36*a* are keep relatively the same. Therefore, in the preferred embodiment, the front panel 12*a*, would have two heights 52*a* and 50*a* (below the tab location, whether left, right or center placed) with a differential between the two of 36*a*, which may correspond generally to the same differential (36*a*) as found in the prior art folder 10, face 12. This will give the improved folder the appearance of the prior art folder.

It is also desirable to increase the cut down of the back panel 14*a*, to insure that other such enlarged tab files (21*a*, 22*a*) can be seen from behind folder 10*a*. This cut down as measured from the top of tab 16*a* to the top of front face 12*a*, but not at the portion having tab 16*a* is indicated as distance 60*a*. Relative to a prior art folder 10, the cut down is of the same general proportion such that tabs behind folder 10*a* are visible. Therefore, the amount of cut down of face 12*a* relative to the maximum height 40*a* (indicated as 60*a*) is sufficient that the enlarged tab behind the folder, but not overlapping will be fully visible with respect to their marking indicia area.

In more general terms, one embodiment of the present invention is achieved by making two cuts deeper than traditionally found in the prior art. This has produced a result by unexpected means (the expected means of making tabs larger is to make them taller, but this violates height restrictions of file cabinets).

In the present invention, where the overall height of the folder is a predetermined X, and the normal tab window (the part of the tab which is visible thru when the front face is overlying) is Y, the improvement is to reduce the height of the front face adjacent to the tab to more than Y, such as Z. In FIGS. 1 and 2, X is shown as 40,40*a*. Y is 30, 30*a*. Z is 32*a* plus 36*a* as shown in FIG. 2 which is larger than 32. This creates a tab, as shown, with roughly double the viewing area of the prior art tab without violating the height restriction rule of existing standards.

A method of achieving the invention of creating a oversized tab without increasing overall file height, therefore includes, a) providing a front and back panel joined to form a folder; b) cutting a portion of the front panel away corresponding to the desired height of the visible writing/labeling surface desired. In FIG. 2 this distance is 32*a*+36*a*, c) cutting down the remaining portion (i.e. the portion not containing the tab) of the back (tab) panel a distance sufficient to expose like tabs of file folders which may be placed behind the present folder. In FIG. 2, this distance is 31*a* which is greater than 31. Of course, 31*a* could include 34*a*.

Figure 3:
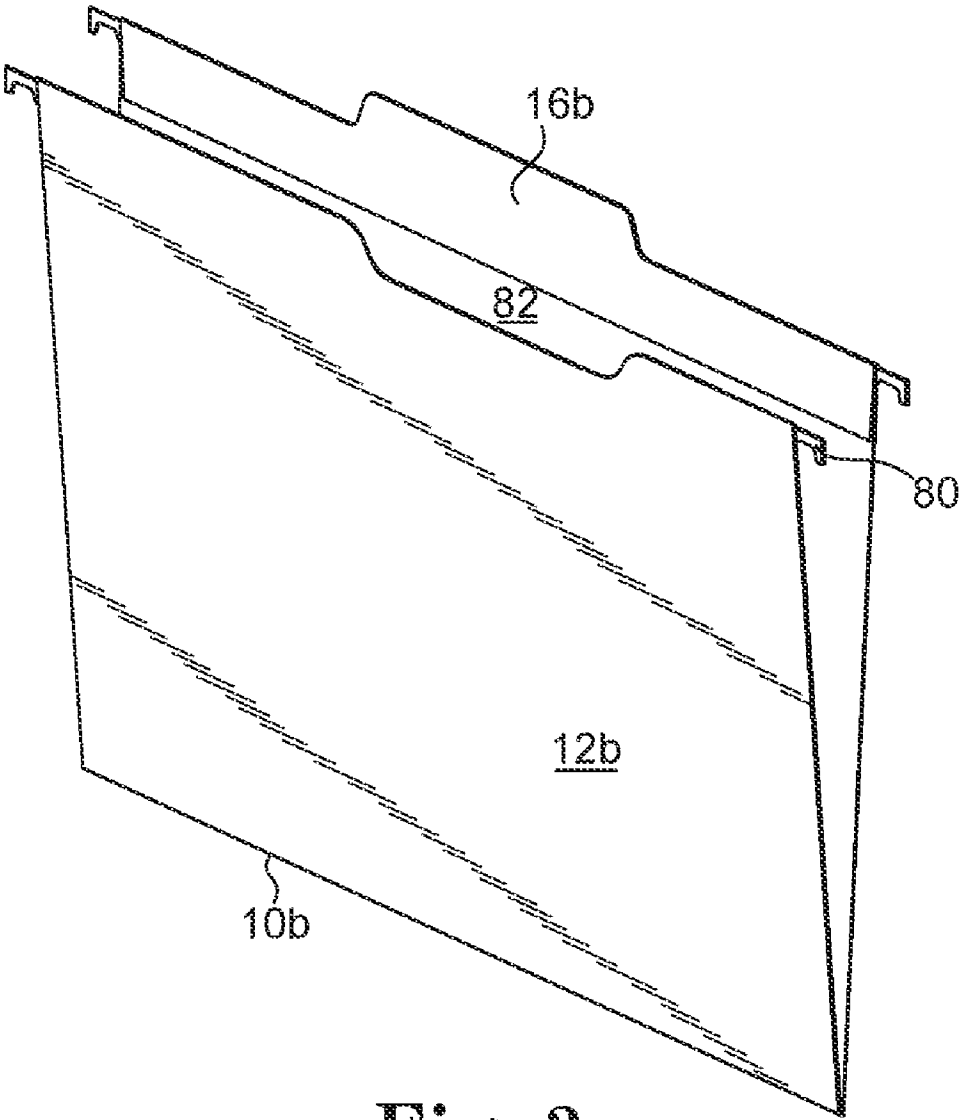
FIG. 3 is a perspective view of a hanging folder version according to the present invention.
Figure 4:
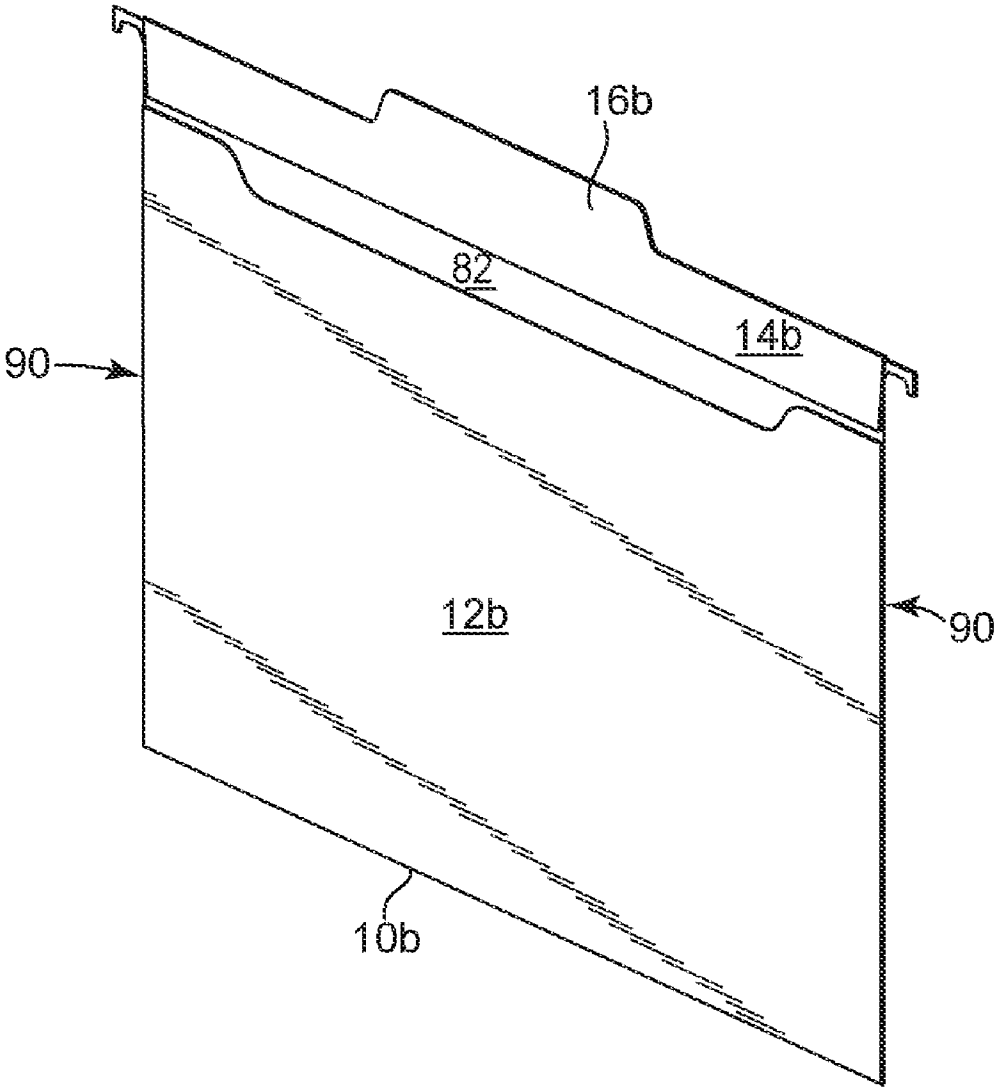
FIG. 4 is a perspective view of another embodiment of a hanging folder according to the present invention.
Figure 5:
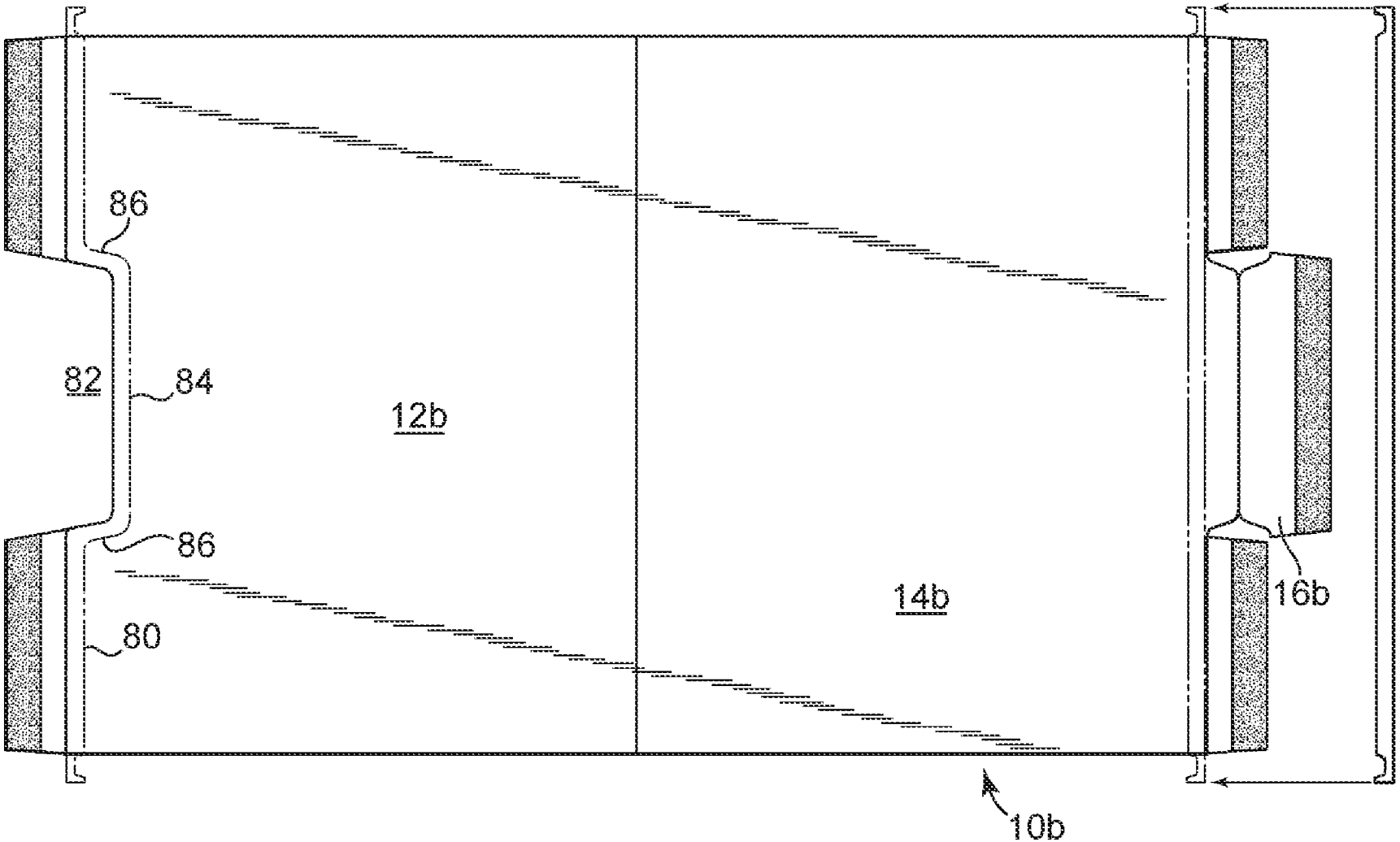
FIG. 5 is a plan view of a hanging folder according to FIG. 3.

FIGS. 3-5 illustrate an embodiment of the present invention applied to hanging folders. Details of hanging folders can be found in the cross reference patent application mentioned above and incorporated by reference. To the extent that elements of this embodiment are the same or similar to the embodiment in FIG. 2 reference numerals will be the same but with an suffix "b" instead of "a" as in FIG. 2.

In this embodiment however, it is necessary to modify the front support rod 80 to include a visual aperture 82 created by offsetting the path of rod 80 to provide the necessary visible indicia space. This "cut down" or "cut out" is accomplished by modifying the path of bar 80 as shown in FIG. 5 where support element 80 includes a pair of offset arms 86 and a connecting portion 84 which creates the cut down region. It is not essential that the support element be a rod or bar in either the front or back panel. It may also be a plate or other rigidified section of the panel 12*b* so long as it is cut down to create the visible indicia space for the label 16*b* (which in FIG. 5 is shown in its pre-folded state to make clear where the interior structures are located). Notice that FIGS. 3-5 illustrate a center tab version, but it is clear that left and right versions are also within the scope of this invention.

FIGS. 3 and 4 differ in two ways. First, FIG. 4 shows a cut down region 82 which may be longitudinally much larger than the mere tab location as in FIG. 3. Second, FIG. 4 illustrates a pocket version which is a file folder (in this case hanging) which has sidewalls 90 which connect faces 12*b* and 14*b* to create a 3 sided pocket. Sidewalls 90 can also be (accordion) gussets to allow expansion.

A method of making a folder with increased visual indicia tab space is also disclosed according to the disclosure above. In a further embodiment, the folder is made from a blank (a larger sheet of material which is usually die cut to specification). The blank is cut to have the following characteristic. The tab on the back panel is exposed by increasing the depth to which the upper edge of the front panel is cut down to expose the back panel. In the region of the tab on the back panel, the front panel cut is made deeper to expose more of the tab. In particular, the cut (usually by a die) is made roughly as deep into the front panel to create a void sufficient to allow the tab section of the back panel to be folded over into the void and not overlap the front panel. The fold line of the tab could be the top edge (38*a*) of the folder. Therefore distance 33*a* in FIG. 2 (the height of the tab 16*a* above the top edge of the back panel 35*a*) is equal to or greater than the distance 31*a* (the distance between the top edge of the back panel 35*a* and the lowest point of the cut 44*a* on the front panel). This construction method will result in the tab 16*a* being foldable onto the back panel without engaging the front panel. Of course the tab is not intended to be folded in normal use, but this geometry is one way to define the depth of the cut on the front panel, though this invention is not limited to such geometric analysis.

Another method involves reducing the front back panel top edge 35*a* (not at the tabbed area) so that it is cut down roughly to the height of the top edge 38*a* of the front panel (not in the tabbed area). This provides maximum viewability of the tabs behind 21*a* and 22*a*.

A further method for making a file folder to have enhanced visual indicia tab with a writable visible tab space larger taller than a predetermined industry standard tab height without increasing the overall folder height. The industry standard tab height 30 in the USA is roughly one-half inch or 12.5 mm. It is not the intention of the inventor to limit the invention to that size or its approximation. The method provides for a folder blank of predetermined dimensions having a front and back panel, the back panel including a tab extension extending upwardly from an edge of the folder generally equal to a predetermined industry standard tab height above the front panel height, the front panel overlying the back panel when the folder is folded thereby covering most of the back panel, and deleting a portion of the front panel which would lie adjacent to the tab extension on the back panel, said deletion creating a recess in the front panel roughly equal to the predetermined standard tab height; so that the exposed portion of the tab extension is roughly equal to twice the predetermined industry standard tab height allowing additional indicia to be written on said exposed portion. The importance is that by deleting (cutting away, forming, molding, etc) the front panel to have a void/recession area which extends downwardly away from and adjacent to the tab extension on the back panel, thereby exposes the tab extension (16*a*) to allow increased writable area without increasing the overall height of the folder 40*a*. The writable portion would therefore be roughly double a predetermined amount and/or industry standard, one half of the height coming from the upward tab extension 30, and the remainder from the downward deletion 34*a*+36*a* in the front panel. The result is a folder product with vastly superior usefulness to the customer who often needs a larger writable area on the tab but is constrained by the height limitations of standard file drawers.

The invention claimed is:

1. A hanging folder comprising:

a) a back panel including top edge and a tab extending upwardly therefrom, b) a support in said panel for support, said support including a pair of rail hooks at distal ends thereof;

c) a front panel including a top edge and a support in said panel for support said support including a pair of rail hooks at distal ends thereof;

d) said top edge of said front panel including a recessed portion in positioned at least under said tab of said back panel, thereby exposing additional portions of the back panel and wherein said support on said front panel includes first and second substantially straight portions extending from said hooks and an offset portion extending from said straight portions and connected thereto.

2. The folder of claim 1 wherein said recessed portion includes a pair of angled portions and a further straight portions connected to said angled portions, said angled portions combined with said further straight portions forming the offset in the support.

3. The folder of claim 2 wherein said support element is a support rod having hooked ends to engage side rails.

4. The folder of claim 2 wherein said tab on said back panel together with said offset on said front panel define a tab aperture area and wherein said area creates a viewable writable tab area larger by virtue of the offset without increasing the height of the tab.

5. The folder of claim 2 wherein said tab may be positioned at a plurality of locations along said support.

6. The folder of claim 2 wherein said tab may include multiple tabs positioned at a plurality of locations along said support.

* * * * *